US006944894B1

(12) United States Patent
Blevins

(10) Patent No.: US 6,944,894 B1
(45) Date of Patent: Sep. 20, 2005

(54) SELF-CLEANING TOILET

(75) Inventor: William J. Blevins, 2549 Piketon Rd., Lucasville, OH (US) 45648

(73) Assignee: William J. Blevins, Minford, OH (US)

( * ) Notice: Subject to any disclaimer, the term of this patent is extended or adjusted under 35 U.S.C. 154(b) by 0 days.

(21) Appl. No.: 10/898,796

(22) Filed: Jul. 26, 2004

(51) Int. Cl.[7] ..... A47K 4/00

(52) U.S. Cl. ..... 4/662

(58) Field of Search ..... 4/312, 319, 320, 4/420, 662

(56) References Cited

U.S. PATENT DOCUMENTS 4,091,473 A * 5/1978 Matthews et al. ..... 4/420
4,174,546 A * 11/1979 Ohtake ..... 4/420
4,726,079 A * 2/1988 Signori et al. ..... 4/420
5,765,237 A * 6/1998 Okamoto et al. ..... 4/300

* cited by examiner

*Primary Examiner*—Justine R. Yu
*Assistant Examiner*—Huyen Le
(74) *Attorney, Agent, or Firm*—Donald W. Meeker

(57) ABSTRACT

A toilet bowl automatically flushes and lowers within a cylinder to a cleaning position. The interior of the bowl is then contacted by a brush cleaning assembly, including a detergent spray and water rinse and then is raised back up to the ready-for-use position.

7 Claims, 4 Drawing Sheets

FIG. 4
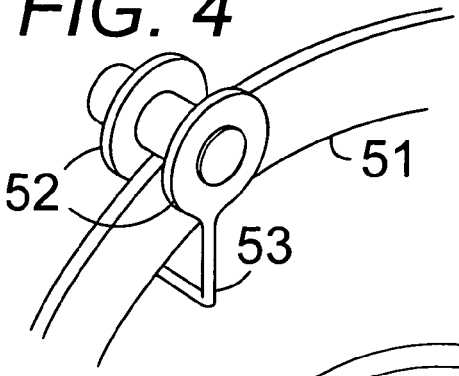
FIG. 5
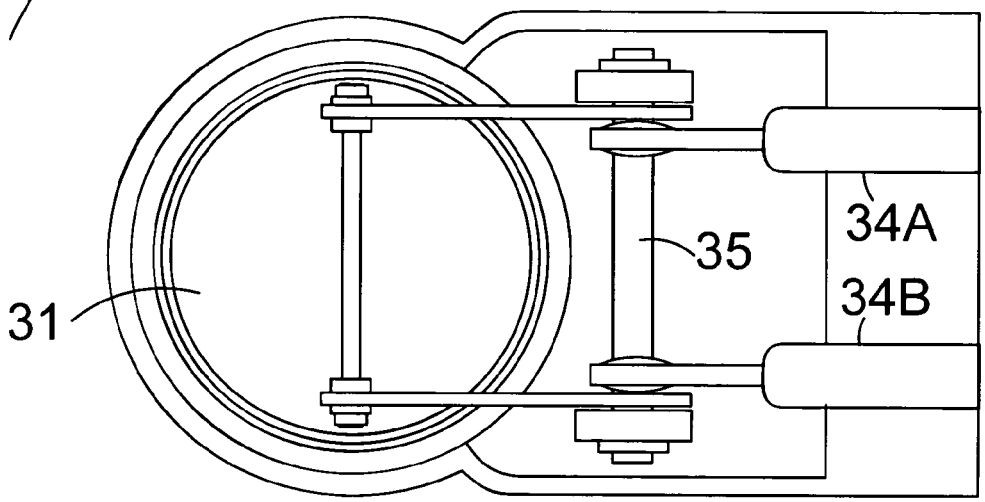
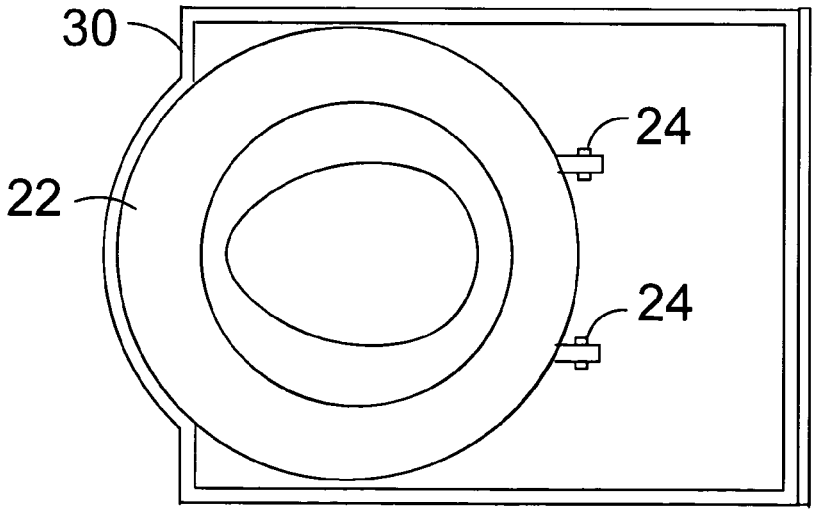
FIG. 6

SELF-CLEANING TOILET

BACKGROUND OF THE INVENTION

1. Field of the Invention

The present invention relates to self-cleaning toilets and particularly to a toilet bowl that automatically flushes and lowers within a cylinder to a cleaning position, the interior of the bowl is then contacted by a brush cleaning assembly, including a detergent spray and then is raised back up to the ready-for-use position.

2. Description of the Prior Art

Cleaning a toilet is important for both aesthetic and health reasons. In addition to the waste that may soil the toilet bowl, a great many water supply systems have bacteria or minerals or other matter that causes stains and deposits in water that is left sitting for any period of time, particularly around the water line. Cleaning toilets in not a pleasant task and few people are likely to enjoy the job, so that it may not be cleaned for a long period of time. The longer the time between cleanings, the more difficult the task becomes because the stains set into the porcelain and require major scrubbing and chemicals to remove them.

While some attempts have been made by the prior art to solve the problem, they do not adequately address the need for high frequency and intensity of cleaning.

U.S. Pat. No. 4,210,973, issued Jul. 8, 1980 to Decaux, puts forth a sanitary unit that comprises at least one vessel such as a bowl, basin or a lavatory pan. In this unit the vessel is movable between a position of use and a cleaning position. The unit comprises rotary brush for cleaning the vessel when the latter is in its cleaning position and means for controlling the displacement of the vessel between the two positions and means for actuating the rotary brush.

U.S. Pat. No. 5,279,008, issued Jan. 18, 1994 to Ritter, concerns a sanitary cell with automatic cleaning device for the toilet bowl. The sanitary cell includes a sanitary chamber, a first technical equipment chamber, for accommodating toilet bowl cleaning appliances, and a wall, which separates the two chambers and which supports, on its opposite sides, two toilet bowls which are located in the sanitary and first technical equipment chambers, respectively. The toilet bowl, which is located in the sanitary chamber, has an opening, which points upwardly. The toilet bowl, which is located in the first technical equipment chamber, has an opening, which points downwardly. A second technical equipment chamber is located beneath the floor of the sanitary chamber. A separating wall pivots about a horizontal axis to enable the pivoting of the toilet bowls from the first technical equipment chamber, through the second technical equipment chamber, and into the sanitary chamber, so that the toilet bowls can be cleaned. The sanitary and technical equipment chambers have respective openings in the area of the respective bowls so as to accommodate their pivotal movement.

U.S. Pat. No. 3,919,726, issued Nov. 18, 1975 to Godwin, puts forth a self-cleaning water closet wherein either the bowl or a specifically provided cabinet-type enclosure is pivotally movable between a first non-cleaning position and a second cleaning position. When in the cleaning position, the cabinet-type enclosure sealably encloses at least a portion of the bowl before washing begins.

U.S. Pat. No. 3,829,906, issued Aug. 20, 1974 to McPhee, concerns a hospital patient care unit, which consists of a folding toilet in a compact cabinet wherein the cowl of the toilet is removable so that the unit can be used either as a bedpan or in the normal manner. The unit is designed so that when it is closed, the bowl is automatically flushed and washed out and an interlock prevents opening the cabinet while the flushing operation is taking place.

U.S. Pat. No. 4,726,079, issued Feb. 23, 1988 to Signori, is for a height adjustable toilet bowl, which includes a water-actuated cylinder for moving it between a low position and a high position. The toilet bowl has a cleaning water circuit adapted to be connected to a water supply pipe, a hose interposed between the cleaning water circuit and the water supply pipe and an outlet pipe connected to a discharge duct through an extensible pipe. The water-actuated cylinder is a flexible cylinder connectable selectively to the water supply pipe and to the cleaning water circuit through a three position valve, a pipe being interposed between the flexible cylinder and the three position valve.

U.S. Pat. No. 5,647,074, issued Jul. 15, 1997 to White, Jr., shows a public toilet facility which is self-cleaning, automatic, and handicapped accessible. The facility offers a toilet that not only lowers from a vertical position to a horizontal position, but can also be adjusted vertically to different heights. High-pressure water jet nozzles are provided within the facility for high pressure cleaning of the toilet bowl and seat when the bowl is in the vertical position. The compact facility has a semicircular door, which is stored behind the equipment and machinery compartment when the facility is unoccupied.

U.S. Pat. No. 5,090,069, issued Feb. 25, 1992 to Decaux, claims a self-cleaning sanitation module that comprises a toilet pan movable between a use position and a cleaning position in which it is behind a separating wall. A back is provided movable between two positions, a use position and a cleaning position in which the back in disposed vertically above the pan. The displacement of the pan and the back between their use position and their cleaning position is performed in such a way that there is always a very small gap between the back and the pan.

U.S. Pat. No. 5,765,237, issued Jun. 16, 1998 to Okamoto, describes a flush pot assembly having a pot, which is concealed when it is not being used. The pot can be easily accessed for use and washed with washing water after use even by a disabled person or a hospital patient. The flush pot assembly includes a pot connected to a flexible drain hose for passing washing water. The pot is provided such that it is integral with a back surface of a door. The door can be opened and closed and constitutes part of one side of a room. The flexible drain hose is connected between the pot and a drainpipe, which leads to the outside of the room. The pot is moved into the room by opening the door and is accommodated in a space outside the room by closing the door.

U.S. Pat. No. 4,797,959, issued Jan. 17, 1989 to Decaux, discloses a sanitary unit having an automatic cleansing cycle. The unit comprises a lockable enclosure in which a partition defines a usage zone and a maintenance zone. A bowl is mounted for rotation between a utilization position in which it projects horizontally from the partition in said usage zone and a cleaning position in which it is tipped up into an opening in the partition so as to empty it into the maintenance zone. The upwards opening of the bowl is separated into two sections by a partition wall which extends upwardly to cooperate with the front walls of the bowl to form a rim surrounding the utilization section of the bowl. The bottom of the partition wall stops short of the base of the bowl to define an orifice and the rear section of the bowl forms an evacuation passage from the evacuation orifice rearwards to the maintenance zone when the bowl is tipped up.

U.S. Pat. No. 4,301,558, issued Nov. 24, 1981 to Decaux, indicates a sanitary unit of the type comprising a vessel, which is mounted to be movable between a position of use and a cleaning position. In the swung over cleaning position, the pan faces the rotary brush and the back part closes the upper part of the drum of the brush so as to preclude any projection of water outside the drum. Further, the drum comprises a water supply system provided with radial perforations, which extend throughout the generatrix of the brush so as to spray the latter and complete the cleaning. The fluid supplied by the system may be pure water or water to which an anti-bacteria or anti-microbe disinfecting solution has been added.

U.S. Pat. No. 5,446,928, issued Sep. 5, 1995 to Daniels, discloses a lift to flush toilet stool. The toilet stool includes a bowl supported above the ground, a flexible hose connecting the bowl to a sewer pipe and a support member for releasably retaining the flexible hose in a trap configuration. The bowl is lifted and the flexible hose substantially straightened to flush the toilet stool.

U.S. Pat. No. 4,091,473, issued May 30, 1978 to Matthews, indicates an adjustable toilet mounted on the wall of a bathroom. The toilet is raised and lowered by an electrically driven motor. By raising and lowering the toilet, the elderly, the handicapped, and children are aided in the use of the toilet. The toilet provides electrical limit switches for stopping the motor at a desired height above the bathroom floor.

What is needed is a toilet cleaning system which works automatically with every flush providing both intense brushing and detergent cleaning.

SUMMARY OF THE INVENTION

An object of the present invention is to provide a toilet cleaning system which works automatically with every flush providing both intense brushing and detergent cleaning always leaving the toilet bowl fresh for the next user and never letting stains build up on the porcelain.

Another object of the present invention is to provide a self-cleaning toilet system which resembles an ordinary toilet in shape and method of use, but which works automatically upon closing the lid to flush, brush, and clean the toilet bowl with detergent and water spray.

One related object of the present invention is to provide a self-flushing and self-cleaning toilet which has a normal seat height but provides a cylinder recessed below floor level in which the toilet bowl automatically descends after the automatic flush and receives a rotary high intensity rotating brush assembly and detergent spray to clean the bowl including a water rinse and then automatically returns the toilet bowl to the normal use level fresh and clean for the next user.

In brief, a toilet bowl is positioned at a normal height within a cabinet housing the inner works of the self-flushing, self-cleaning toilet. Upon closing the lid over the toilet seat after use, the toilet automatically flushes and lowers inside a sealed cylinder down below the floor level. A motor and spiral impeller assist gravity to guarantee a clean flush of all matter in the bowl. A brush assembly with rotary brushes and a detergent spray pivots down into the bowl and thoroughly cleans the bowl. A water spray removes any loose matter as well as detergent residue. The toilet bowl is then lifted back to the normal use position fresh and clean for the next user. Liquid seals and flexible waste lines and water lines and detergent lines enable the movement of the elements.

To enable the movement of all the parts by the simplest means, two solenoids are used: a first to lower the bowl and pivot the brush assembly into the bowl and a second solenoid to pivot the brush assembly out of the way and lift the cleaned toilet bowl back up to the normal use position. The operation takes place within the sealed cylinder and with the toilet lid closed, which closure activates the automatic flushing, brushing, detergent cleaning, and water rinsing operation.

An advantage of the present invention is that it automatically cleans the toilet bowl with every flush always leaving the toilet bowl fresh for the next user and never letting stains build up on the porcelain.

Another advantage of the present invention is that it is a self-cleaning toilet system which resembles an ordinary toilet in shape and method of use, but which works automatically upon closing the lid.

A further advantage of the present invention is that it conceals all of the cleaning elements and has a normal seat height.

BRIEF DESCRIPTION OF THE DRAWINGS

These and other details of my invention will be described in connection with the accompanying drawings, which are furnished only by way of illustration and not in limitation of the invention, and in which drawings:

FIG. 4 is a perspective view of the track riding element showing the toilet bowl moving arm in the bracket under the roller of the track riding element;

FIG. 5 is a top plan view of the interior works of the automatic flushing and self-cleaning toilet system of FIG. 1 with the toilet bowl in the down cleaning position and the brush assembly over the toilet bowl with the brushes in the toilet bowl cleaning the bowl;

FIG. 6 is a top plan view of the top of the cabinet cover showing the toilet seat in the down position for usage.

BEST MODE FOR CARRYING OUT THE INVENTION

In FIGS. 1–6, a self-cleaning toilet system 20 scrubs a toilet bowl clean with every flush. The system comprises a cabinet 30 housing a movable toilet bowl 21 and brush assembly 31.

Figure 1:
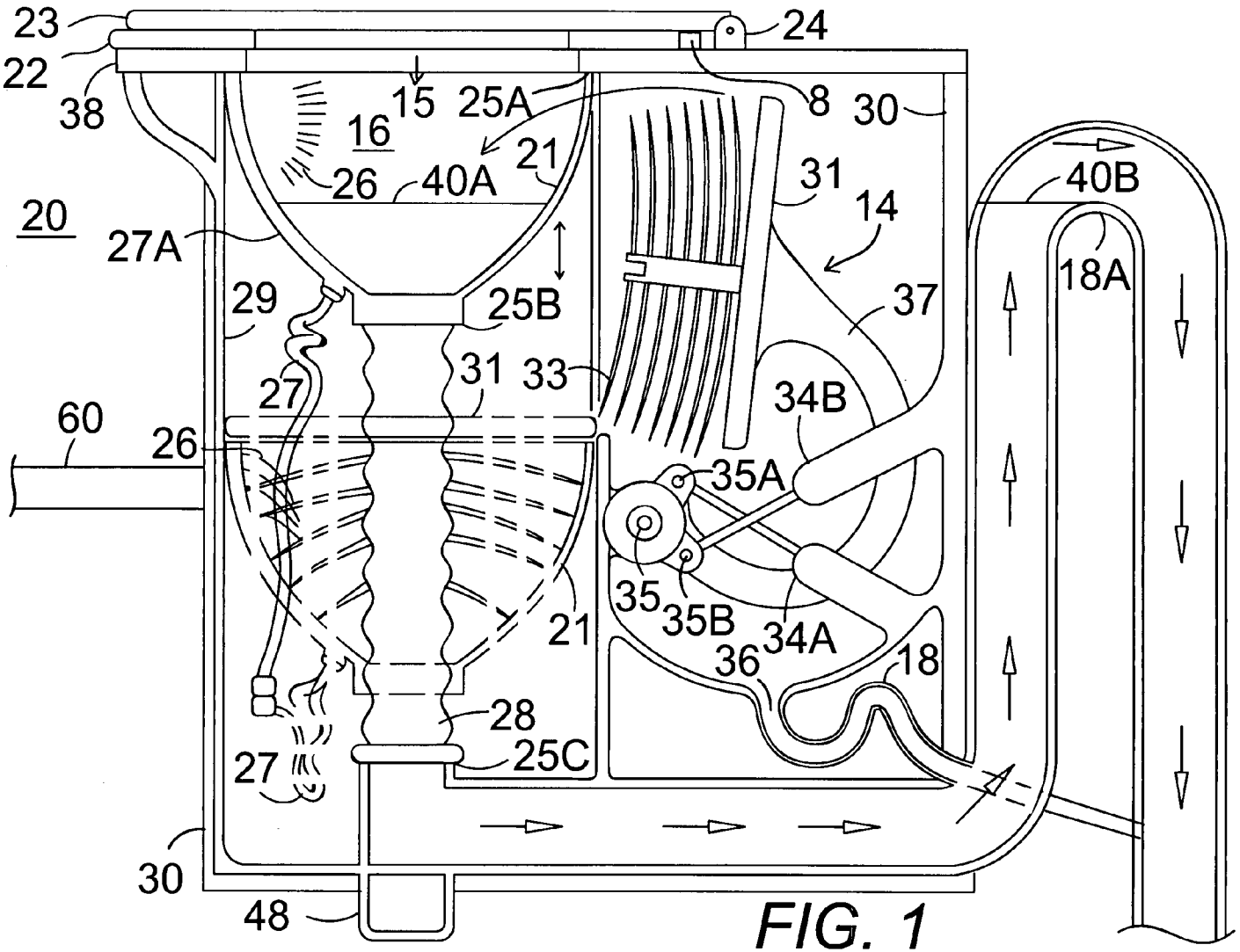
FIG. 1 is a cross-sectional view of the automatic flushing and self-cleaning toilet system of the present invention showing the main toilet bowl and brush assembly components in the cabinet.
Figure 2:
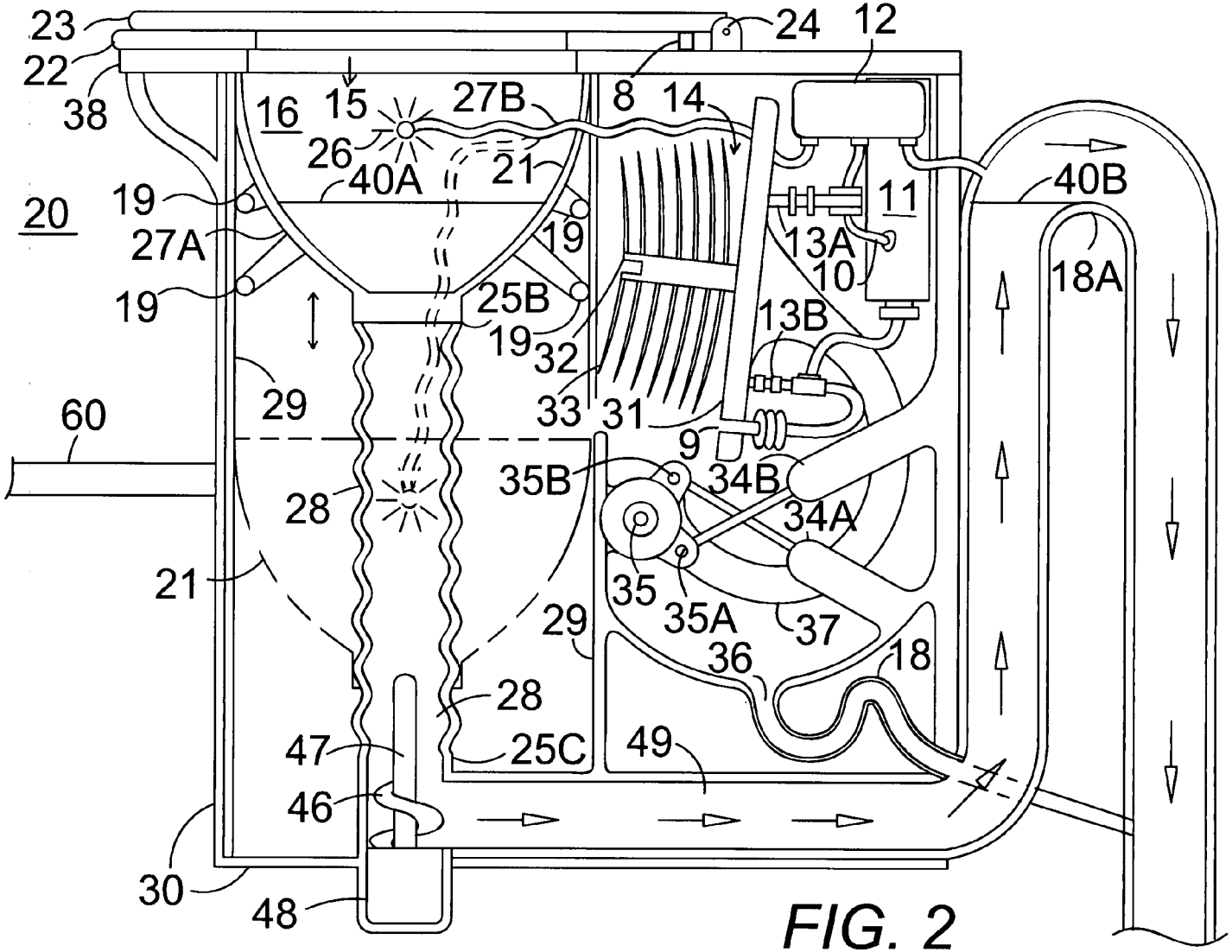
FIG. 2 is a cross-sectional view of the automatic flushing and self-cleaning toilet system of FIG. 1 showing the main toilet bowl and brush assembly components in the cabinet with additional features such as the guide rollers on the toilet bowl, the detergent and water spray elements of the brush assembly, and the motor and spiral impeller in the drainage tube.
Figure 3:
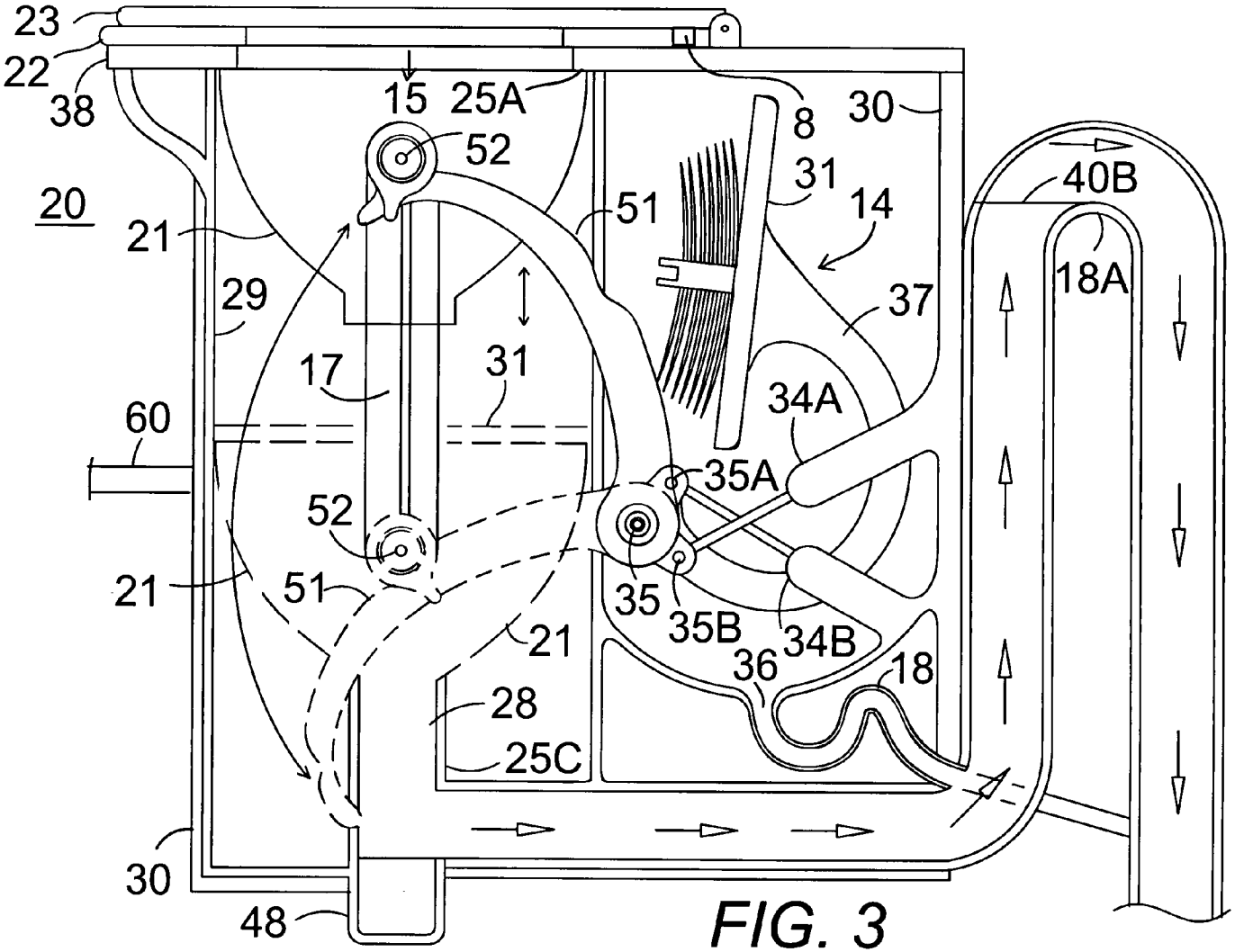
FIG. 3 is a cross-sectional view of the automatic flushing and self-cleaning toilet system of FIG. 1 showing the main toilet bowl and brush assembly components in the cabinet and the toilet bowl moving arm, the track riding element, and the vertical track with the toilet bowl and arm in the up and down positions.

In FIGS. 1–3, the cabinet 30 is mounted partially below and partially above a level of a floor 60. A top cover 38 of the cabinet is at a height of a standard toilet bowl. The cabinet 30 comprises an enclosure with a hollow interior and a top cover 38 having a top cabinet opening 15 therethrough and a hinged toilet seat ring 22 and toilet seat cover 23 pivotally mounted over the top opening 15. A vertical sealed cylinder 29 has at least one vertical track 17 (FIG. 3) attached to an interior of the vertical sealed cylinder.

A toilet bowl 21 is movably positioned within the vertical sealed cylinder 29 inside the cabinet below the top cabinet opening 15 normally in a first usage position (solid lines) in contact with the top cover 38. The toilet bowl has a waste receiving bowl interior 16, a top bowl opening coinciding with the top cabinet opening 15 for use in communication with the waste receiving bowl interior 16, at least one water inlet opening 26 adjacent to the top bowl opening, a bottom opening for drainage with a seal 25B, at least one external protruding track riding element 52 slidably engageable in the vertical track 18, as shown in FIG. 3, and at least one toilet bowl moving arm 51 pivotally attached to the cabinet and engaged with the track riding element 52.

The toilet bowl 21 is adapted to move from the first usage position (solid lines) down to a second cleaning position (dashed lines) below the first position in response to a downward motion of the toilet bowl moving arm 51 with the track riding element 52 slidable in the vertical track 17 between the two positions, and after cleaning back up to the first position (solid lines) in response to an upward motion of the toilet bowl moving arm 51.

In FIG. 4 the track riding element 52 comprises a pivotable roller 52 with an offset loop 53 and the at least one toilet bowl moving arm 51 comprises a rigid arched elongated arm fitting slidably within the loop 53.

A contractible and extendable drainage tube, such as an accordian rubberized tube 28, is attached at a top end to the bottom opening of the toilet bowl with a seal 25B in communication with the waste receiving bowl interior 16 and attached at a bottom end by a seal 25C to a trap 18A leading to a sewer system, the drainage tube adapted to remain attached at both ends during movement of the toilet bowl 21.

At least one contractible and extendable water tube, such as a flexible water hose 27 attached at a top end to the at least one water inlet 26 (either directly or through a built-in water channel 27A in the toilet bowl 21) in communication with the waste receiving bowl interior and attached at a bottom end to a water supply such as a standard water pipe, the water tube 27 adapted to remain attached at both ends during movement of the toilet bowl 21, as indicated by the change of the water tube 27 from solid lines to dashed lines in FIG. 1.

A brush assembly 14 is pivotally attached at a pivot point 35 to an interior of the cabinet 30 by a brush pivot arm 37. The brush assembly 14 comprises at least one rotary brush 33 rotatably mounted on a pivot post 32 on a brush plate 31 and at least one detergent sprayer comprising at least one outlet 9 in the brush plate fed by detergent lines 13B from a detergent reservoir 11. The brush assembly is adapted to pivot from a normal position (solid lines) adjacent to the toilet bowl 21 down into the toilet bowl 21 in the second position (dashed lines) and clean the toilet bowl and to pivot back up away from the toilet bowl after cleaning to the normal position (solid lines).

A pair of solenoids 34A and 34B are each attached at a first end to the cabinet 30. A first solenoid 34A is attached at a second end by a pivot point 35A on a protruding lever arm of the brush pivot arm 37 and the toilet bowl moving arm 51 so that activation of the first solenoid 34A pivots the toilet bowl moving arm 51 to lower the toilet bowl 21 (from solid lines to dashed lines) and activates the brush pivot arm 37 to lower the brush assembly 14 from the normal position (solid lines) into the bowl 21 (dashed lines). A second solenoid 34B is attached at a second end by a pivot point 35B on a protruding lever arm of the brush pivot arm 37 and the toilet bowl moving arm 51 so that activation of the second solenoid 34B activates the brush pivot arm 37 to pivot the brush assembly 14 up out of the way to the normal rest position (solid lines) and activates the toilet bowl moving arm 51 to raise the cleaned toilet bowl 21 back up to the normal use position (solid lines).

A solenoid activation means, which may be a control button 8, is positioned on the top cover 38 of the cabinet in communication with the toilet seat cover 23 so that closing the toilet seat cover 23 activates the water tube 27 to flush the toilet bowl 21 and activates by a timer means the first solenoid 34A and second solenoid 34B in sequence to lower the toilet bowl, clean the toilet bowl and return the toilet bowl to the use position for a self-flushing, self-cleaning toilet.

The system may further comprise rollers 19, as shown in FIG. 2, extending from an exterior of the toilet bowl 21, the rollers adapted for engaging an interior of the vertical sealed cylinder 29 for guiding movement of the toilet bowl 21 therein.

The system may further comprise a motor 48 and spiral impeller shaft 47 and blade 46 within the drainage tube 28 to assist gravity in removing waste matter from the toilet bowl 21.

The system may utilize the above mentioned water tube 27 or an additional water tube 27B with a water reservoir 12 to spray a water spray 26 after removal of the brush assembly to remove any loose matter as well as detergent residue in the toilet bowel 21. A water spray may also cleanse the residue from the outflow of waste water 40B in the trap 18A to the sewer.

An additional drain 36 with a trap 18 leading to the sewer line may be used to drain off water and detergent from the brush assembly 14.

The toilet bowl 21 my be fabricated of porcelain or stainless steel or other materials normally used for that purpose.

It is understood that the preceding description is given merely by way of illustration and not in limitation of the invention and that various modifications may be made thereto without departing from the spirit of the invention as claimed.

What is claimed is:

1. A self-cleaning toilet system for scrubbing a toilet bowl clean with every flush, the system comprising:

a cabinet mounted partially below and partially above a level of a floor with a top of the cabinet at a height of a standard toilet bowl, the cabinet comprising an enclosure with a hollow interior and a top cover having a top cabinet opening therethrough and a hinged toilet seat ring and toilet seat cover pivotally mounted over the top opening, and a vertical sealed cylinder with at least one vertical track attached to an interior of the vertical sealed cylinder;

a toilet bowl movably positioned within the vertical sealed cylinder inside the cabinet below the top cabinet opening normally in a first usage position in contact with the top cover, the toilet bowl having a waste receiving bowl interior, a top bowl opening for use in communication with the waste receiving bowl interior, at least one water inlet opening adjacent to the top bowl opening, a bottom opening for drainage, at least one external protruding track riding element slidably engageable in the vertical track, and at least one toilet bowl moving arm pivotally attached to the cabinet and engaged with the track riding element, so that the toilet bowl is adapted to move from the first usage position down to a second cleaning position below the first position in response to a downward motion of the toilet bowl moving arm with the track riding element slidable in the vertical track between the two positions, and after cleaning back up to the first position in response to an upward motion of the toilet bowl moving arm;

a contractible and extendable drainage tube attached at a top end to the bottom opening of the toilet bowl in communication with the waste receiving bowl interior and attached at a bottom end to a trap leading to a sewer system, the drainage tube adapted to remain attached at both ends during movement of the toilet bowl;

at least one contractible and extendable water tube attached at a top end to the at least one water inlet in communication with the waste receiving bowl interior and attached at a bottom end to a water supply, the water tube adapted to remain attached at both ends during movement of the toilet bowl;

a brush assembly pivotally attached to an interior of the cabinet by a brush pivot arm, the brush assembly comprising at least one rotary brush and at least one detergent sprayer, the brush assembly adapted to pivot down into the toilet bowl in the second position and clean the toilet bowl and to pivot back up away from the toilet bowl after cleaning;

a pair of solenoids each attached at a first end to the cabinet, a first solenoid attached at a second end the brush pivot arm and the toilet bowl moving arm so that activation of the first solenoid activates the toilet bowl moving arm to lower the toilet bowl and activates the brush pivot arm to lower the brush assembly into the bowl, and a second solenoid attached at a second end to the brush pivot arm and the toilet bowl moving arm so that activation of the second solenoid activates the brush pivot arm to pivot the brush assembly up out of the way and activates the toilet bowl moving arm to raise the cleaned toilet bowl back up to the normal use position;

a solenoid activation means positioned on the top cover of the cabinet in communication with the toilet seat cover so that closing the toilet seat cover activates the water tube to flush the toilet and activates the first solenoid and second solenoid in sequence to lower the toilet bowl, clean the toilet bowl and return the toilet bowl to the use position for a self-flushing, self-cleaning toilet.

2. The system of claim 1 further comprising rollers extending from an exterior of the toilet bowl, the rollers adapted for engaging an interior of the vertical sealed cylinder for guiding movement of the toilet bowl therein.

3. The system of claim 1 wherein the drainage tube is an accordian tube.

4. The system of claim 1 wherein the at least one water tube is a flexible hose.

5. The system of claim 1 further comprising a motor and spiral impeller within the drainage tube to assist gravity in removing waste matter from the toilet bowl.

6. The system of claim 1 the at least one water tube is adapted to spray a water spray after removal of the brush assembly to remove any loose matter as well as detergent residue in the toilet bowl.

7. The system of claim 1 wherein the track riding element comprises a pivotable roller with an offset loop and the at least one toilet bowl moving arm comprises a rigid arched elongated arm fitting slidably within the loop.

* * * * *